US005191162A

United States Patent [19]

Czimmek

[11] Patent Number: 5,191,162

[45] Date of Patent: Mar. 2, 1993

[54] METHOD AND APPARATUS FOR A SHIP-BASED ROCKET LAUNCHING STRUCTURE

[75] Inventor: Dieter W. Czimmek, Yorktown, Va.

[73] Assignee: Newport News Shipbuilding and Dry Dock Company, Newport News, Va.

[21] Appl. No.: 755,338

[22] Filed: Sep. 5, 1991

[51] Int. Cl.[5] ..... B63B 35/00; F41F 3/042

[52] U.S. Cl. ..... 89/1.802; 114/61; 114/65 R; 89/1.815

[58] Field of Search ..... 89/1.8, 1.801, 1.802, 89/1.805, 1.815; 114/61, 65 R

[56] References Cited

U.S. PATENT DOCUMENTS

| | | | |
|---|---|---|---|
| 2,735,391 | 2/1956 | Bushers | 89/1.802 |
| 2,968,410 | 1/1961 | Hamilton et al. | 89/1.805 |
| 2,975,747 | 3/1961 | Opie | 114/61 |
| 3,593,684 | 7/1971 | Cogliano | 114/61 |
| 3,835,802 | 9/1974 | Vernède et al. | 114/61 |
| 4,573,396 | 3/1986 | Streetman et al. | 89/1.815 |
| 4,747,334 | 5/1988 | Kuriiwa | 89/1.802 |
| 4,916,999 | 4/1990 | Palmer et al. | 89/1.815 |
| 5,042,358 | 8/1991 | Kuriiwa | 89/1.815 |
| 5,052,324 | 10/1991 | Lesly | 114/61 |
| 5,086,721 | 2/1992 | Burkard | 114/61 |

OTHER PUBLICATIONS

"How to Handle 24-Megaton Thrust", in *Missles and Rockets*, Jun. 1959, Chauncy J. Hamilton, Jr., pp. 16-18.

"Sea Launch Studied for Space Vehicles", Larry Booda, in *Aviation Week*, Dec. 1960, vol. 73, No. 24, pp. 69, 73, 75 and 79.

*Primary Examiner*—David H. Brown

*Attorney, Agent, or Firm*—Lalos & Keegan

[57] ABSTRACT

Method and apparatus for launching at sea a rocket with a satellite or military weapon payload. At a staging point where trusses, rockets and other requirements are located, two ships are aligned side by side and interconnected with the trusses rigidly connecting and holding the ships a predetermined distance apart to form a rocket launcher. A pivotable cradle on a truss connecting the ships' mid-sections is used for supporting a rocket above the sea. Exhaust gases from the rocket at time of launch are directed downward onto the sea, and the cradle is rotatable for directing the launch of the rocket at various angles. Cooling sprayers provide protection of the structure from excessive heat occurring at blast-off by pumping sea water onto the structure. Support apparatus includes cranes for transport of the rockets and recovery of launch material from the sea.

20 Claims, 2 Drawing Sheets

METHOD AND APPARATUS FOR A SHIP-BASED ROCKET LAUNCHING STRUCTURE

FIELD OF THE INVENTION

The present invention relates generally to structures for launching rockets, and more specifically, to a ship-based cradle for launching large rockets at sea.

BACKGROUND OF THE INVENTION

In recent years there has been an increased reliance upon satellites for defensive purposes, such as communications, weapons and other military uses. The loss of a satellite could disrupt these vital military systems. The assurance, therefore, of continuous, multi-satellite operations throughout the world has become a matter of prime importance. In this regard, timely launching of rockets with suitable payloads, is essential.

An integral part of such an operation is not only the launching capability, but also the location from which the rocket is deployed. The launch system must be strategically located, and be in an on-call status, in various parts of the world to realize maximum effectiveness. The launch location is particularly significant, for example, when sending replacement satellites into a predefined orbit. Numerous advantages are found in a launch capability from the vast expanses covered by the oceans. Thus, efforts have been made to provide a suitable rocket launching structure in an ocean environment.

One example of an ocean launching structure for space rockets is with the use of multiple floating platforms that include a launching platform, a rocket servicing platform, and a hangar platform, all mounted and transported on a carrier having a semi-submersible hull. The carrier moves to a designated ocean area, whereupon a rocket, floated from the hull in a semi-submersible state on the ocean, is set on the launchpad platform. The type of launching apparatus provides for the simultaneous loading and transportation of the three platforms in carrying out the rocket launch, and is described in the patent to Kuriiwa, U.S. Pat. No. 4,747,334. However, a propellant supply ship is necessary for supplying propellants, such as liquefied hydrogen, liquefied oxygen, etc., to the rocket at the launching site. Further, a separate satellite supply ship is required when the launch site is used, for example, to send into orbit a reconstitution satellite. Also a tug boat must be positioned on the carrier with the three platforms for use in floating the launchpad platform off the carrier and positioning it at an intended launching site.

It is also known to use a sea-going vessel, such as a modified tanker, as a mobile launcher. In U.K. Patent Application No. GB 2172247A to Copson, a launcher for an expendable space vehicle (ESV) uses an ESV launchpad on a modified tanker, along with support apparatus for handling the ESV and loading it with a payload package. ESV support means, equipment for transferral of fuel, and a launch operations control center are also on the tanker. However, the modifications required to the tanker include adding blast protection in the proximity of the launchpad, such as cladding to deflect and project flames away from the pad. The launchpad must still be on or near the bow of the tanker, even with blast protection provided, and such modifications are costly as well as limiting available launch storage and work space.

Yet another type of rocket launch has been proposed based upon a battleship's rotatable gunbarrel structure in providing a rocket launching gun, such as is found in U.S. Pat. No. 2,426,610 to Hopkins. The patent describes the carrying, servicing, and firing of large rockets from a water surface vessel or a submarine using a long range gun. The gun is rotatable from a horizontal position to project a rocket at various angles relative to the surface of the water to accomplish benefits associated with both low and high angle fire. One feature is an open breech of the rocket gun whereby the exhaust gas produced by the rocket-missile acts directly on the surface of the sea. Operation of a rocket gun is described as being accomplished both on and under the surface of the sea. However, operation of the launcher requires use on a vessel having some superstructure lending less stability from the rocking motion of the ocean, and also offering limited space as is needed for storage of multiple rockets.

There has also been disclosed a method of constructing a submersible ocean structure for downward launching, in a sense, of equipment for gas and oil exploration. A drilling rig, for example, is mounted onto a multiplicity of legs, which are connected to pontoons consisting of standard surplus submarine hulls, modified for use in connection with the drilling rig structure. A self-propulsion unit moves the rig to desired locations in the sea, and the use of existing and submersible submarine hulls provides financial savings in producing a sea-going mobile platform, while also providing a more stable support cradle in the water environment. Such a structure is described in U.S. Pat. No. 3,874,314 to Sanders.

While these methods and apparatus for an ocean platform, and in particular for a structure for launching a rocket with a desired payload at sea, are suitable for some operations, they have drawbacks that have thus far limited the rocket launch capability. Such drawbacks include the undesired movement or instability of the launch site on the ocean, and space restrictions in the storage and servicing of rockets and related apparatus necessary for the launch operations. Also the capability for prompt rocket launching from movable worldwide ocean locations at a reasonable cost has been found lacking in much of the prior art disclosures of such structures.

SUMMARY OF THE INVENTION

In view of the foregoing, it is apparent that there exists a need in the art for a floatable or ocean-going rocket launching structure that offers stability of the launch platform, long-term mobility in providing a launching capability from remote points of the earth, while at the same time being cost effective. With these and other benefits in mind, it is, therefore, a primary object of the present invention to provide an ocean-based rocket launcher formed of two ships aligned side by side, with at least one interconnecting truss rigidly connected between the two ships and containing a rotatable cradle as part of the interconnecting truss for holding a rocket.

More particularly, the present rocket launcher is made of an alignment of the two ships side by side with three trusses interconnecting the two ships, one at the bow, a second at the stern and the third at mid-section including the rotatable cradle, and wherein the trusses are portable for disassembly and storage at staging points on land.

Cooling means are provided for protecting the launch apparatus and ship hulls from excessive heat during lift-off. The cooling means may consist of cooling sprayers along with appropriate pumping means to use the sea water for spraying onto predetermined areas to provide the cooling protection. Another feature of the invention is a rocket launcher containing transport means on at least one of the ships for movement of the rockets and for recovery of materials from the sea.

A method for launching a rocket at sea is also provided based upon the apparatus of the disclosed invention. Briefly described, the method comprises steps of modifying and structurally reinforcing two essentially identical ships to receive trusses, rockets, fuel tanks, launching controls and other necessary items for launching the rocket; positioning the trusses, rockets, fuel tanks, launching controls and other necessary items at strategically-located staging points in the world; bringing the two ships together to a staging point; mounting the trusses, rockets, fuel tanks, launching controls and other launching apparatus on the ships, and loading the fuel, rocket payloads and other necessary items on the ships; sailing the two ships connected by said trusses, to a desired launching location; ballasting the two ships to a desired depth while positioning a rocket with a payload in the launching cradle; tilting the rocket cradle with said rocket in an upright launching position; fueling the rocket and preparing the payload; and launching the rocket while cooling with water spray those parts of the ships subject to impingement of rocket exhaust.

Through the use of this invention, satellite reconstitution, that is, launching satellites to replace those disabled by an enemy or by other agencies is possible.

Other features and advantages of the invention will be set forth in, or apparent from, the detailed description of the preferred embodiments of the invention which follow.

BRIEF DESCRIPTION OF THE DRAWINGS

For a complete understanding of the method and structure of the invention, reference is made to the following detailed description and the accompanying drawings, wherein.

DETAILED DESCRIPTION OF THE PREFERRED EMBODIMENTS

Figure 1:
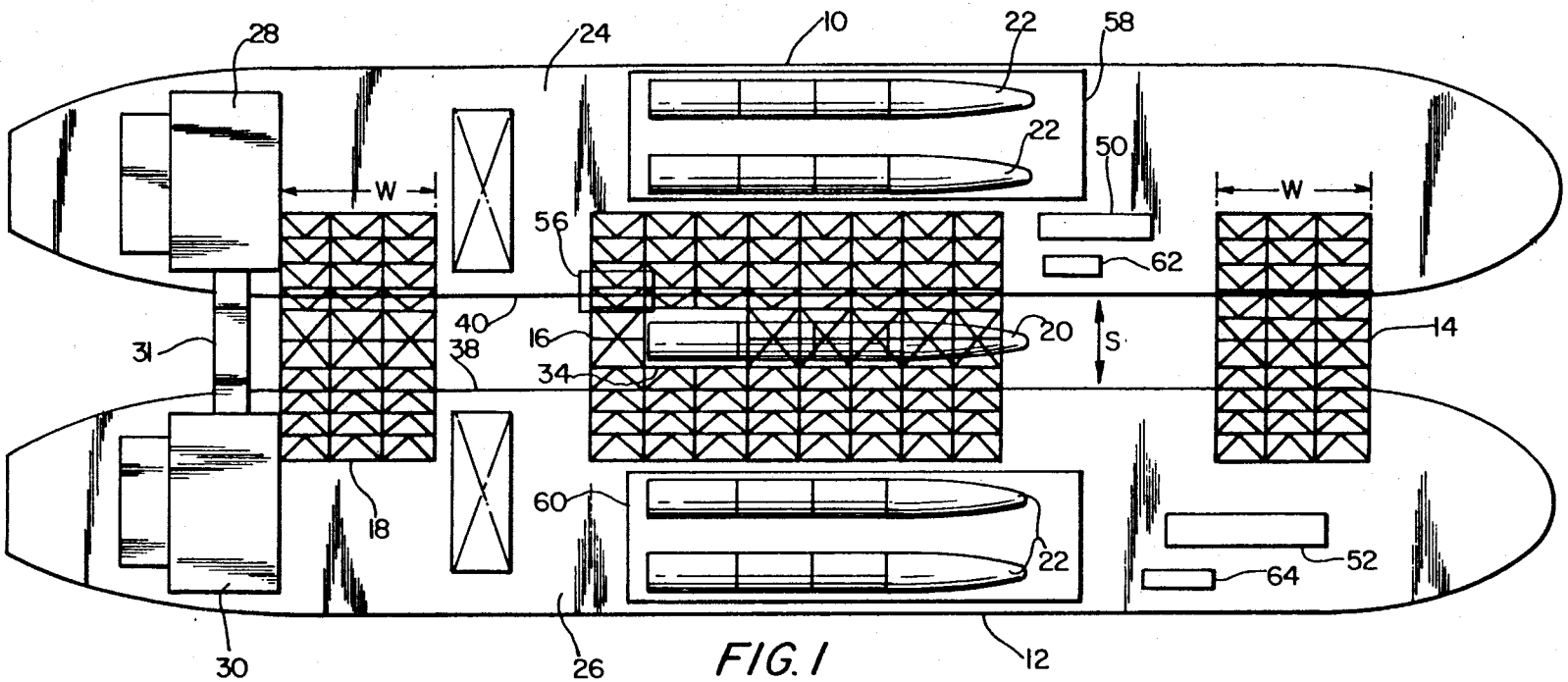
FIG. 1 shows a top view of two ships with interconnecting launch assembly structure with rockets depicted on a center launchpad and in storage on each of the ships.

FIG. 1 shows a top view of the rocket launch assembly constructed according to a preferred embodiment of the invention. Two ships, 10 and 12, are positioned alongside one another with a separation distance "S" of from 30 to 40 feet. Ships 10 and 12 have a displacement of from 20,000 to 40,000 tons and are of equal size. The ships preferably are from the laid-up commercial fleet or from the Navy reserve fleet, and therefore are of minimum cost but such ships may be ships in service, particularly tankers. The ships are connected by trusses 14, 16, and 18. Connections between the bows and sterns of the ships are formed with front and rear trusses 14 and 18, secured to the decks 24, 26 and lower parts of hulls 10, 12 of each ship. Center truss 16 is also connected to the decks 24, 26 and lower parts of hulls 10, 12 of each ship and serves as the launching platform. FIG. 1 shows rocket 20 in a horizontal position prior to being placed upright for launching. The horizontal storage of additional rockets is seen by the representative rockets 22, shown as two rockets in storage areas 58 and 60 on each ship 10 and 12, respectively. The two ship bridges 28, 30 for ships 10 and 12, respectively, are also connected by an enclosed passageway 31 at bridge height for personnel movement. Operation of the two ships and maneuvering controls (not shown) are electromechanically combined on the bridge of one ship for coordination of the dual ship launch operation.

Figure 2:
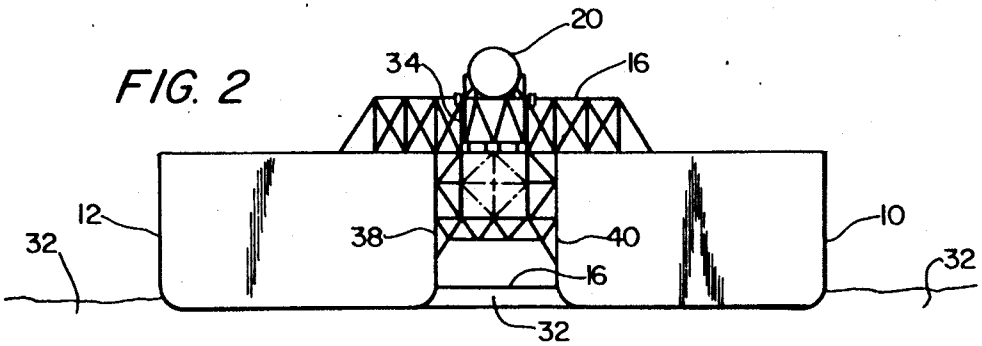
FIG. 2 depicts the front end view of the ships with a rocket horizontally positioned in a cradle on the launch structure.

FIG. 2 shows generally a front end view of the two ships 10, 12 afloat on the water 32, with the two ships tied together by the trusses as shown in FIG. 1. Only truss 16 associated with the launching platform is presented in FIG. 2 for ease of illustration. Details of trusses 14, 16 and 18 are not further described herein as they are well-known in the art. Rocket 20 is shown in a horizontal position in a cradle 34 on the launch platform that comprises truss 16 and is located near or at the midpoints of the two ships.

Figure 3:
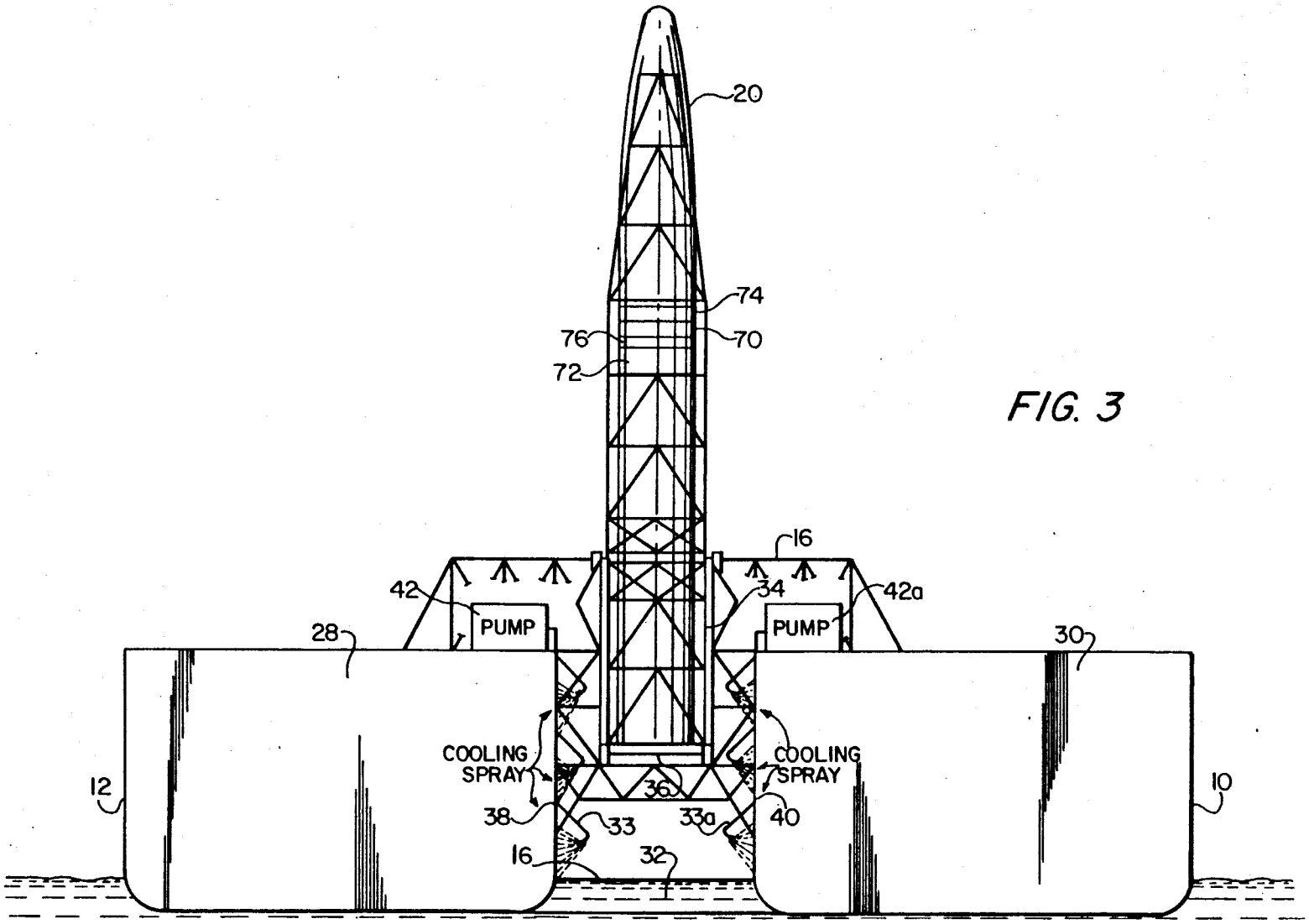
FIG. 3 illustrates a front end view of the launch structure with rocket in position for launching.

In preparing to launch the rocket, the ships 10, 12 are ballasted down to provide increased stability. Launching cradle 34, in which the assembled rocket is held in a horizontal position, is tilted with hydraulic cylinders and counterweights (shown generally as 56 in FIG. 1) into the vertical position. Such a rocket ready for takeoff is depicted in FIG. 3, where rocket 20 is supported by truss 16 with cradle portion 34 thereof in a vertical position providing support for the base of rocket 20. With this arrangement, exhaust gases exit relatively close to the surface of the water, and impinge directly on the surface. Thus, the sea absorbs most of the heat from the rocket exhaust, and elaborate heat dissipation means are not required as they are with land-based launch pads or prior art ship-based launch systems. Nevertheless, additional cooling of the inside hulls 38, 40 and truss 16 will be necessary. Therefore, an external spray system comprising a plurality of sprayers 33 is positioned along the inside hulls 40 and 38 of both ships 10 and 12 as shown in FIG. 3, to provide a cooling spray against the hulls of ships 10 and 12 during rocket takeoff. While the sea 32 is the primary dissipator of exhaust heat of rocket 20 on takeoff, the external spray system also uses sea water to cool the ships' inside hulls and truss work during liftoff. A suitable water pump 42 is provided on ship 12 for delivering the water to sprayers 33 on inside hull 38 of ship 12. A similar pump **42*a* is also provided on ship 10 carrying out the same function on inside hull 40 of ship 10. It will be understood that, while only three sprayers are depicted in FIG. 3 for use on each ship, other sprayer arrangements could just as easily be used, both for the inside hull sections 38, 40 as well as for the truss. Also, various types of water pump arrangements, generally represented at 42, 42*a*, in FIG. 3, could be used. For example, a single pumping station could provide the water supply to all sprayers, or more than two pumps could be used based upon the amount of cooling needed for a given rocket launch. FIG. 3 also illustrates a conventional satellite 70 secured as a payload to rocket 20 by conventional securing apparatus 74, and including conventional apparatus 72 for separating satellite 70 from rocket 20 and conventional apparatus 76 for inserting satellite 70** into orbit.

In operation, tankers are the preferred type of ships to be used because of their essentially clear decks 24, 26 forward of the bridge structure 28, 30. Also, their large storage capacity is advantageous in substantially improving the range and endurance of the floatable rocket launching system such as in time of war. The launching system could then be hidden, for example, in the South Pacific and greater time intervals could be realized between launches. Although tankers are preferred for the reasons indicated, it is understood that other types of ships could also be employed in such a rocket launching system as is described.

The trusses 14, 16 and 18, and cradle 34 in the midsection area of center truss 16, can all be prefabricated, for example during peace time if the launch system is to be used in a military application, for use on designated pairs of ships in service, or for laid up ships. The appropriate trusses, cradles, fuel tanks, servicing cranes and rockets can then be strategically located and stored at staging points such as on the east, west and Gulf coasts. The ships 10, 12 themselves can be structurally reinforced and modified to the extent necessary ahead of time to accommodate the trusses, fuel tanks and other items incidental to the operation, as well as providing for storage of multiple rockets on each ship.

At the appropriate time, the two designated ships are directed to the staging point. The trusses, fuel tanks, launching controls, spray systems, etc., are installed on the ships to form them into the launch platform. Rocket fuel is loaded into the fuel tanks and rockets, payloads and other apparatus and expendable items are loaded aboard according to a prearranged schedule. If the rockets are solid fuel rockets, they are loaded aboard as received. The payload may include various devices such as a satellite or weapons and the like.

This two-ship launch platform is much more stable than the single-ship platforms of the prior art. This platform may then be sailed to a desired launching station or location. Upon notice, a rocket 20 is lifted by a deck mounted crane 50, 52 from its shipping position to launching cradle 34. Other rockets 22 are placed in position for ready movement into the deployment position once rocket 20 is fired. Generally two mobile cranes 50, 52 on each ship 10 and 12 are sufficient to accommodate the servicing and transport of the rockets shipboard, as well as to accomplish retrieval of used rocket sections from the ocean surface. In the case of liquid fuel rockets, decks may also accommodate the tanks 62, 64 for storage of the liquid rocket fuel, or liquid rocket fuel may be stored below the decks. Once assembled, the rocket is tilted from a horizontal to a vertical position by use of hydraulic cylinders and counterweights 56 using techniques well-known in the art. Thereafter, the liquid fuel and oxidizer are loaded into the rocket tanks from separate locations. The rocket is then ready for ignition. When solid fuel rockets are used, the loading is, of course, not required. The cooling spray system is activated at an appropriate time relative to the rocket ignition so that no damage occurs to the ship hulls, or other structural areas, during liftoff. After launching, the satellite payload, for instance, is inserted into earth orbit in a manner well known in the art.

In the launch system described, the safety factor is also greatly enhanced for in the event of a disaster, the ships and the crews have a much greater chance of survival compared to a single-ship platform and launch arrangement. Cranes 50, 52 aboard ship can also be used to retrieve spent material from the sea. The two-ship base for the launch platform also provides the benefit of added hotel space for both ship crew and rocket launching crew, since two deck houses are available. Only the bridge of one ship will generally be needed for active launch support operations.

Although the invention has been described in the preferred embodiment as comprising use of two ships, in an alternative embodiment ships are not used, but rather any type of two floating bodies, such as barges, could be similarly equipped and moved from a staging point to a desired location in the ocean for the rocket launch.

It will be understood by those skilled in the art that, although the invention has been described in relation to exemplary preferred embodiments thereof, variations and modifications can be effected in these preferred embodiments without departing from the scope and spirit of the invention.

We claim:

1. An ocean-based rocket launcher comprising:

two ships aligned side by side; and at least one interconnecting truss rigidly connected between said two ships, said at least one interconnecting truss including a tiltable cradle for holding a rocket.

2. A rocket launcher according to claim 1, wherein said two ships each including a deck are aligned side by side along their respective longitudinal axes a predetermined distance apart, and said interconnecting truss including said tiltable cradle is connected to the deck of each of said two ships near the midpoints thereof.

3. A rocket launcher according to claim 1, comprising a first truss interconnecting said two ships at the respective bow section of each ship, a second truss connected between said two ships at the respective stern section of each ship, and a third truss including said rotatable cradle connected between said two ships.

4. A rocket launcher according to claim 1, wherein said rocket launcher includes transport means on at least one of said two ships for movement of said rocket onto said tiltable cradle, and for recovery of materials for the sea.

5. The rocket launcher according to claim 1, wherein said rocket includes a satellite.

6. A rocket launcher according to claim 1, wherein said at least one interconnecting truss comprising a tiltable cradle further comprises cooling means for protecting said rocket launcher from excessive heat.

7. A rocket launcher according to claim 6, wherein said cooling means comprises a plurality of cooling sprayers and pumping means connected to said cooling sprayers for pumping sea water for spraying onto predetermined areas during the time of rocket launch.

8. A ship-based rocket launcher for use with two ships aligned side by side at sea including storage means and launch support means, said rocket launcher comprising:

at least one truss connected between said two ships;

a tiltable rocket cradle provided on said truss for supporting above the sea a rocket comprising a rocket base from which exhaust gases are expelled;

supply means for transport of rockets from said storage means on at least one of said two ships into said rocket cradle;

tilting means for positioning said rocket for launch by movement of said rocket cradle about said truss.

9. A ship-based rocket launcher according to claim 8, wherein said rocket launcher further comprises fuel supply means for supplying fuel to a rocket.

10. A ship-based rocket launcher according to claim 8, wherein said rocket cradle includes means for positioning said rocket base towards the ocean when the rocket is pointing upwardly, essentially perpendicular to the plane of the surface of the sea.

11. A method for launching a rocket at sea comprising the steps of:

positioning two ships at a staging point;

interconnecting said two ships by means of trusses at the respective bows and sterns of said two ships, and with a connecting truss comprising a rocket cradle;

positioning a rocket in said rocket cradle;

tilting said rocket cradle to a desired launch position; and launching said rocket wherein exhaust gases from the rocket impinge substantially directly on the surface of the sea, and concurrent with said launching.

12. A method according to claim 11, wherein the step of interconnecting with a connecting truss includes positioning said rocket cradle near the respective midpoints of said two ships.

13. A method according to claim 11, wherein the interconnecting of said two ships includes the positioning of said rocket cradle above the sea between the two ships.

14. A method for launching a rocket according to claim 11, wherein the step of positioning a rocket includes the step of moving a rocket from storage means on or within at least one of said two ships.

15. A method according to claim 11, wherein after the step of interconnecting said two ships, the said two ships are sailed to a desired launch location in the ocean.

16. A method according to claim 15, wherein after the two ships are sailed to said launch location, the method includes the step of submerging the said two ships in the ocean to a predetermined depth.

17. A method according to claim 11, including the step of cooling at least during the time of launch predetermined areas of said ships and said launch apparatus by cooling means using water from the sea.

18. A method according to claim 17, wherein the step of cooling includes the pumping of water from the sea by pumping means into a plurality of sprayers for spraying said water onto the connecting truss and onto the hulls of said two ships.

19. A method for launching a rocket at sea comprising the steps of:

modifying and structurally reinforcing two essentially identical ships to receive trusses, rockets, rocket payloads, fuel tanks, launching controls and other necessary items for launching the rocket;

positioning the trusses, rockets, fuel tanks, launching controls and other necessary items at strategically-located staging points in the world;

bringing the two ships together to one of said staging points;

mounting the trusses, rockets, fuel tanks, launching controls and other launching apparatus on the ships, and loading the fuel, rocket payloads and the like necessary items on the ships;

sailing the two ships connected by said trusses, to a desired launching location;

ballasting the two ships to a desired depth while positioning a rocket with a payload in the launching cradle;

tilting the rocket cradle with said rocket in an upright launching position;

fueling the rocket and preparing the payload; and launching the rocket while cooling with water parts of the ships subject to impingement of rocket exhaust.

20. A method of satellite reconstitution comprising:

positioning two ships at a staging point;

interconnecting said two ships by means of trusses;

supporting a rocket cradle on one of said trusses;

positioning a rocket in said rocket cradle;

securing a satellite as a payload to said rocket;

launching said rocket with said satellite;

separating said satellite from said rocket; and inserting said satellite into earth orbit from said rocket.

* * * * *

UNITED STATES PATENT AND TRADEMARK OFFICE

CERTIFICATE OF CORRECTION

PATENT NO. : 5,191,162

DATED : March 2, 1993

INVENTOR(S) : Dieter W. Czimmek

It is certified that error appears in the above-identified patent and that said Letters Patent is hereby corrected as shown below:

In column 6, Claim 3, last line, "rotatable cradle" should read -- tiltable cradle --.

Signed and Sealed this

Sixteenth Day of November, 1993

Bruce Lehman

*Attest:*

BRUCE LEHMAN

*Attesting Officer*

*Commissioner of Patents and Trademarks*